US011518559B2

(12) United States Patent
Karlsson et al.

(10) Patent No.: US 11,518,559 B2
(45) Date of Patent: Dec. 6, 2022

(54) ARRANGEMENT FOR GUIDING A WIRE IN A WIRE BINDING MACHINE AND A WIRE BINDING MACHINE COMPRISING THE ARRANGEMENT

(71) Applicant: Husqvarna AB, Huskvarna (SE)

(72) Inventors: Magnus Karlsson, Ljungbyholm (SE); Lennart Gustafsson, Rockneby (SE)

(73) Assignee: HUSQVARNA AB, Huskvarna (SE)

( * ) Notice: Subject to any disclaimer, the term of this patent is extended or adjusted under 35 U.S.C. 154(b) by 547 days.

(21) Appl. No.: 16/500,635

(22) PCT Filed: Apr. 4, 2018

(86) PCT No.: PCT/SE2018/050353

§ 371 (c)(1),
(2) Date: Oct. 3, 2019

(87) PCT Pub. No.: WO2018/186794

PCT Pub. Date: Oct. 11, 2018

(65) Prior Publication Data

US 2020/0095000 A1 Mar. 26, 2020

(30) Foreign Application Priority Data

Apr. 6, 2017 (SE) ..... 1750419-2

(51) Int. Cl.
*B65B 13/06* (2006.01)
*E04G 21/12* (2006.01)

(52) U.S. Cl.
CPC ..... *B65B 13/06* (2013.01); *E04G 21/123* (2013.01)

(58) Field of Classification Search
CPC .. B21F 23/00; B21F 15/04; B21F 7/00; E04G 21/122; E04G 21/123; B65B 13/04; B65B 13/06; B65B 13/285; B65B 13/28
(Continued)

(56) References Cited

U.S. PATENT DOCUMENTS 6,000,443 A 12/1999 Hayashi et al.
2006/0157139 A1* 7/2006 Hoyaukin ..... E04G 21/123 140/119
2016/0090749 A1 3/2016 Shindou

FOREIGN PATENT DOCUMENTS

JP H06167115 A 6/1994
JP H07-48931 A 2/1995
(Continued)

OTHER PUBLICATIONS

Swedish Search Report for Application No. 1750419-2 dated Oct. 25, 2017.
(Continued)

*Primary Examiner* — Jessica Cahill
*Assistant Examiner* — Bobby Yeonjin Kim
(74) *Attorney, Agent, or Firm* — Burr & Forman, LLP

(57) ABSTRACT

Described herein is an arrangement (1) for guiding a wire in a wire binding machine (3), wherein the arrangement (1) comprises a guide member (5) and a first spring (7) arranged to act with a first spring force against the guide member (5), wherein the guide member (5) is arranged to bear against the wire and act against the wire with said first spring force in order to guide the wire during a wire binding process when the wire moves relative to the guide member (5). The guide member (5) is arranged so that a movement of the guide member (5) substantially away from the wire is allowed in order to reduce friction forces between the guide member (5) and the wire during the wire binding process, so that locking of the wire against the guide member (5) is prevented. Also described herein is a wire binding machine (3) comprising an arrangement (1).

2 Claims, 6 Drawing Sheets

(58) Field of Classification Search
USPC ..... 140/93.2, 123.5, 118, 119, 123.6, 149
See application file for complete search history.

(56) References Cited

FOREIGN PATENT DOCUMENTS

| | | | | |
|---|---|---|---|---|
| JP | 2016-030625 | A | 3/2016 | |
| KR | 20100035850 | A | 4/2010 | |
| WO | 93/02816 | A1 | 2/1993 | |
| WO | 2007/042785 | A2 | 4/2007 | |
| WO | 2008/044002 | A2 | 4/2008 | |
| WO | 2008/062213 | A2 | 5/2008 | |
| WO | WO-2008062213 | A2 * | 5/2008 | ..... B65B 13/285 |
| WO | 2010/119260 | A1 | 10/2010 | |

OTHER PUBLICATIONS

International Search Report and Written Opinion for International Application No. PCT/SE2018/050353, dated May 30, 2018.
International Preliminary Report on Patentability for International Application No. PCT/SE2018/050353 dated Oct. 8, 2019.

* cited by examiner

ARRANGEMENT FOR GUIDING A WIRE IN A WIRE BINDING MACHINE AND A WIRE BINDING MACHINE COMPRISING THE ARRANGEMENT

TECHNICAL FIELD

Within, for example, the construction industry, wire binding machines are used to bind together elongated objects with the aid of a wire, especially to bind together reinforcement rods. The present invention relates to an arrangement for guiding a wire in a wire binding machine and to a wire binding machine comprising the arrangement.

BACKGROUND OF THE INVENTION

Traditionally, wire binding of, for example, reinforcement rods for casting of concrete elements was effected with the aid of simple, manual tools, which is very time-consuming and hence costly. Moreover, manual wire binding can give rise to repetitive strain injuries in a user of a manual tool of this kind. For this, wire binding machines which make the wire binding process considerably more efficient and considerably reduce the risk of repetitive strain injuries have been developed.

A wire binding machine usually comprises two claws having guide surfaces for a binding wire, which claws are led over, for example, reinforcement rods which are to be bound together with the aid of binding wires. Binding wires are fed along the guide surface of one claw and over to the guide surface of the other claw in order to get around the rods. After the binding wire has been wound round, it is tightened with the aid of a mechanism inside the machine. During tightening, the movement of the wire is very often stabilized with the aid of an arm which presses against the wire. In this way, the wire is controlled during the tightening.

Document WO2007042785 shows an example of an above-described wire binding machine comprising a spring-loaded arm arranged to keep a wire tightened with the aid of two springs.

A drawback with known wire binding machines is that there is a risk of the wire not being properly tightened when a knot is to be formed, which can cause reinforcement rods, for example, to not be correctly and tightly bound together.

In the light of the above, there is a need for an improved arrangement for guiding a wire in a wire binding machine and an improved wire binding machine.

SUMMARY OF THE INVENTION

An object of the present invention is to provide an improved arrangement for guiding a wire in a wire binding machine and an improved wire binding machine.

This object is achieved according to one aspect of the present invention by means of an arrangement for guiding a wire in a wire binding machine, wherein the arrangement comprises a guide member and a first spring arranged to act with a first spring force against the guide member. In other words, the guide member and the first spring are arranged so that the first spring force, which is generated by the first spring, can be transmitted to the guide member.

In addition, the guide member is arranged to bear against the wire and act against the wire with the first spring force in order to guide the wire during a wire binding process when the wire moves relative to the guide member. The guide member hence has contact with the wire during the wire binding process, and the first spring force can be transmitted via the guide member to the wire in the form of a compressive force. The wire can in this way be guided, i.e. held in a position relative to the guide member and the wire binding machine with the aid of the guide member during the wire binding process when the wire moves relative to the guide member.

The guide member is also arranged so that a movement of the guide member substantially away from the wire is allowed in order to reduce friction forces between the guide member and the wire during the wire binding process, so that locking of the wire against the guide member is prevented.

The friction forces between the guide member and the wire arise during the wire binding process when the guide member bears against the wire which moves relative to the guide member. In certain situations during the wire binding process, the friction forces can increase, which can pose a risk of locking of the wire against the guide member.

By "the movement of the guide member substantially away from the wire is allowed" is meant that the guide member or a part of the guide member can move, i.e. change position relative to the wire in a direction away from the wire, but not toward the wire. For example, the guide member or a part of the guide member can move in a direction substantially perpendicular to the extent of the wire.

Friction forces between the guide member and the wire during the wire binding process can hence be reduced in a simple and effective manner by said movement of the guide member substantially away from the wire. As a result, locking of the wire against the guide member can be prevented, since, in the event of excessive friction forces between the guide member and the wire, the guide member can change its position relative to the wire in a direction away from the wire. In addition, a robust arrangement for guiding a wire in a wire binding machine is provided.

Consequently, an improved arrangement is provided and hence the above-stated object is achieved.

As an alternative, the guide member can be arranged so that the movement of the guide member substantially away from the wire is allowed by a deformation of the guide member. Hence the shape of the guide member can be altered and, in this way, said movement substantially away from the wire can be realized in a simple manner.

Alternatively, the guide member can comprise an elastic material, which enables said guide member to have elastic properties. In other words, the guide member can be resilient. Hence said deformation of the guide member, i.e. said alteration of the shape of the guide member, can be realized in a simple manner.

According to certain embodiments, the guide member can be arranged rotatably about a shaft, and the first spring can be arranged so that the first spring force induces rotation of the guide member about the shaft toward the wire. Hence the guide member can rotate about the shaft and, as a result, the guide member can be positioned to bear against the wire and act against the wire with the first spring force in order to guide the wire during the wire binding process.

As an alternative, the movement of the guide member substantially away from the wire can induce a movement of the shaft substantially away from the wire. A change of position of the guide member, such as a displacement of the guide member relative to the wire, thereby induces a change in the position of the shaft relative to the wire, for example a displacement of the shaft. Consequently, the guide member can be fastened to the shaft in order to form a unit with the shaft. As a result, a robust arrangement for guiding a wire in a wire binding machine is provided.

As a further alternative, the arrangement can comprise a mounting part for mounting of the shaft, wherein the mounting part can comprise a groove arranged to allow the movement of the shaft substantially away from the wire. The shaft can hence be installed in the mounting part and, furthermore, said movement of the shaft substantially away from the wire can be facilitated with the aid of the groove in the mounting part.

As an alternative, the guide member can comprise a guide element arranged to bear against the wire and act against the wire with the first spring force. Hence the first spring force can be transmitted to the wire via the guide member. The first spring force can then be transmitted via the guide element to the wire in the form of a compressive force. The wire can in this way be guided, i.e. held in a position relative to the guide element and the wire binding machine with the aid of the guide element during the wire binding process.

In addition, the guide element is movably arranged so that a movement of the guide element substantially away from the wire is allowed in order to reduce friction forces between the guide element and the wire during the wire binding process.

The movement of the guide element substantially away from the wire means that the guide element can move, i.e. change position, relative to the wire in a direction away from the wire. For example, the guide element can move in a direction substantially perpendicular to the extent of the wire. In this way, friction forces between the guide element and the wire can be reduced during the wire binding process, so that locking of the wire against the guide element is prevented.

Alternatively, the guide member can comprise a recess arranged to allow the movement of the guide element substantially away from the wire at least partially in the recess. As a result, the guide element can move, i.e. change position, at least partially inside the recess. Consequently, the movement of the guide element substantially away from the wire can be facilitated, since the guide element can be led at least partially by the recess during the movement of the guide element substantially away from the wire. In addition, installation of the guide element on the guide member is facilitated with the aid of the recess.

The guide element can comprise a ball. During the wire binding process, the guide element is arranged to bear against the wire and act against the wire with the first spring force when the wire moves relative to the guide element. With the ball, the movement of the wire relative to the guide element can be facilitated. In addition, a simple guide element, which can be produced at lower costs, is realized.

In addition, the arrangement can comprise a second spring arranged to counteract the movement substantially away from the wire with a second spring force. The second spring force, which is generated by the second spring, can therefore act in a direction which is substantially opposite to the direction for the movement substantially away from the wire. Hence said movement away from the wire can be limited and balanced with the aid of the second spring. As a result, said contact between the guide member and the wire, as well as compressive forces against the wire, can be maintained and regulated with the second spring force during the wire binding process. Hence an improved guidance of the wire during the wire binding process can be realized.

The arrangement can comprise a tensioning device for regulating the second spring force. The second spring force can thereby be adjusted and adapted with the aid of the tensioning device in dependence on various drive factors during the wire binding process.

The tensioning device can comprise a screw. Hence the second spring force can be regulated in a simple manner by screwing of the screw. Consequently, a robust tensioning device is realized.

As an alternative, the wire binding process can comprise tightening of the wire when a knot is to be formed, wherein the arrangement can be used during the tightening of the wire.

According to a further aspect, this object is achieved with a wire binding machine comprising an arrangement as is herein described.

DESCRIPTION OF THE FIGURES

Various aspects of the invention, inclusive of its particular characteristic features and advantages, emerge from the following detailed description and the associated drawings, in which.

DETAILED DESCRIPTION

The present invention is described below in greater detail with reference to the accompanying drawings, in which examples of embodiments are shown. The invention should not be interpreted as being limited to the described examples of embodiments. Same numbers in the figures refer throughout to same elements.

Figure 1:
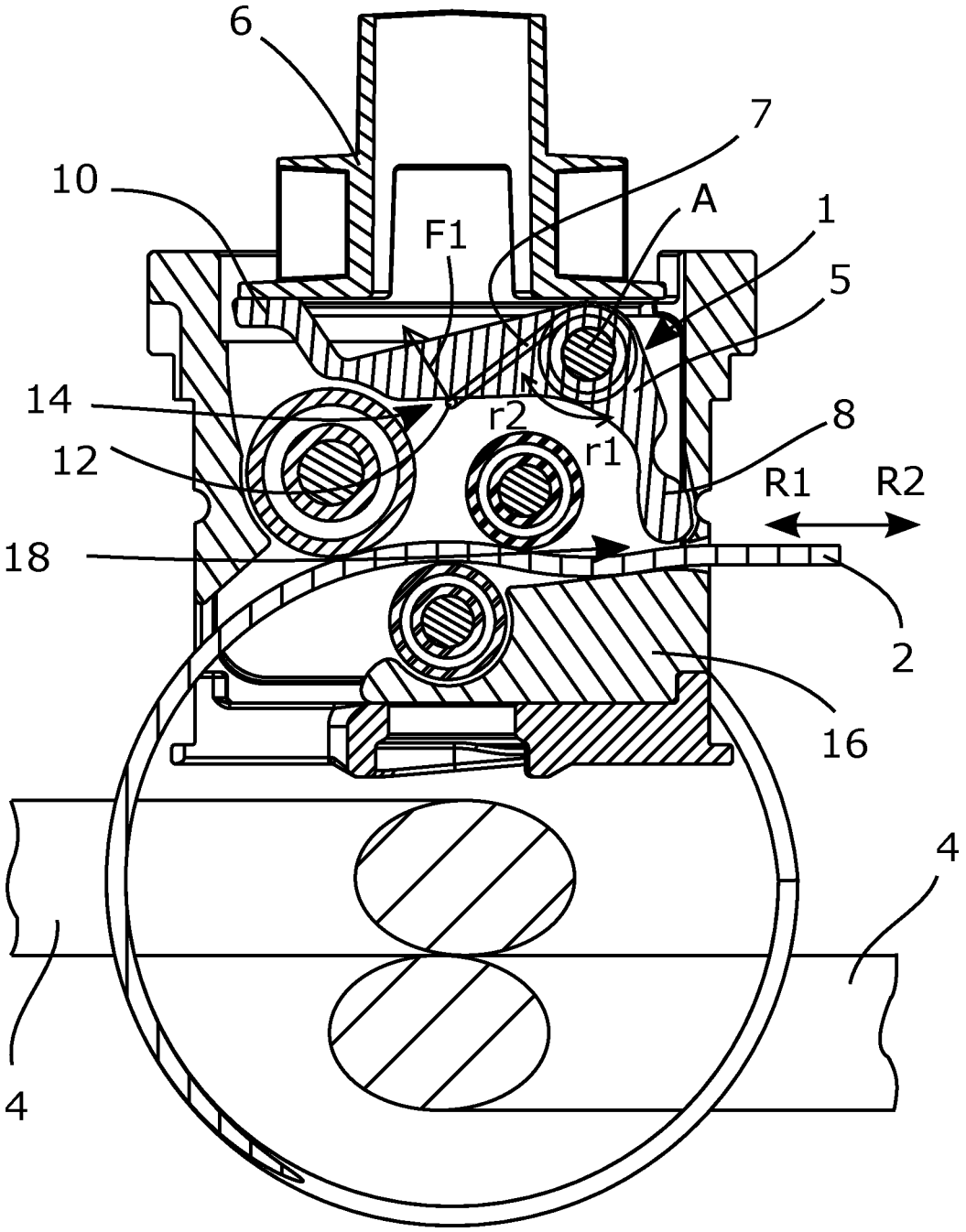
FIG. 1 shows an embodiment of an arrangement for guiding a wire in a wire binding machine in a first position for feed-out of the wire.

FIG. 1 shows an arrangement 1 for guiding a wire 2 in a wire binding machine. The arrangement 1 is shown according to one embodiment. In FIG. 1, only a part of the wire binding machine in which the arrangement 1 is mounted is shown. The arrangement 1 is illustrated in a first position for feed-out of the wire 2. The arrangement 1 comprises a guide member 5 and a first spring 7 arranged to act with a first spring force F1 against the guide member 5. The guide member 5 does not have contact with the wire 2 in said first position which is illustrated in FIG. 1, so that the wire 2 can pass freely past the guide member 5 during feed-out of the wire 2 in a first phase of a wire binding process, in which, for example, rods 4 are to be bound together. The wire 2 is fed out with the aid of mechanisms in wire binding machines, which mechanisms function in a known manner and is therefore not described in detail herein. The wire 2 is fed out in a first direction R1. The arrangement 1 can be positioned in said first position with the aid of a guide cylinder 6.

The guide member 5 can be configured, for example, as a lever comprising a front part 8 and a rear part 10. Front and rear relate to position relative to the wire 2, i.e. the front part 8 is arranged closer to the wire 2 than the rear part 10. The front part 8 is arranged to be able to come into contact with the wire 2, and the rear part 10 is arranged to be able to come into contact with the guide cylinder 6. The front part 8 can have a shape of an arm having a round end contact surface in order to facilitate contact with the wire 2 in the second position described in connection with FIG. 2-4.

Figure 2:
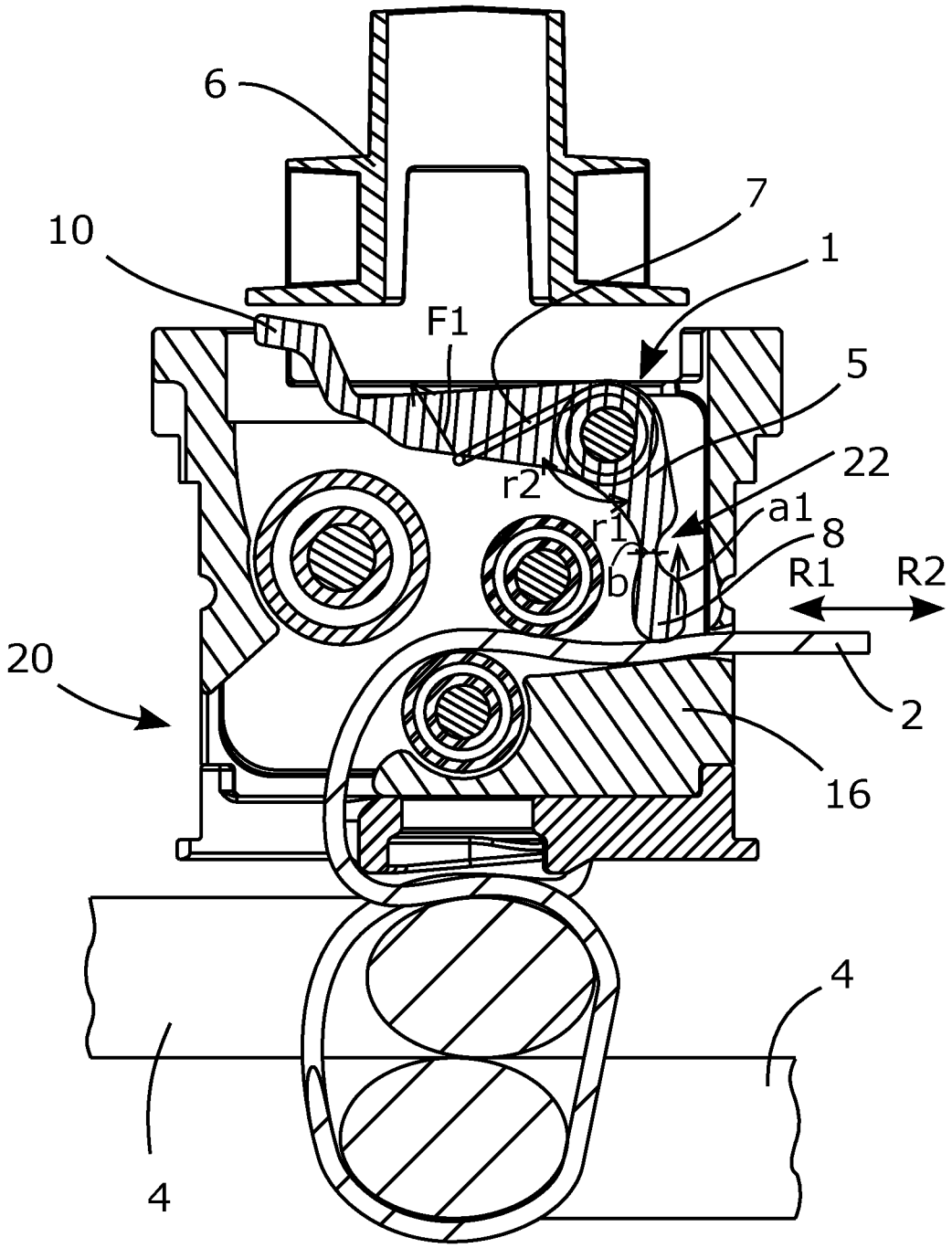
FIG. 2 shows the arrangement in FIG. 1 in a second position for guidance of the wire.
Figure 3:
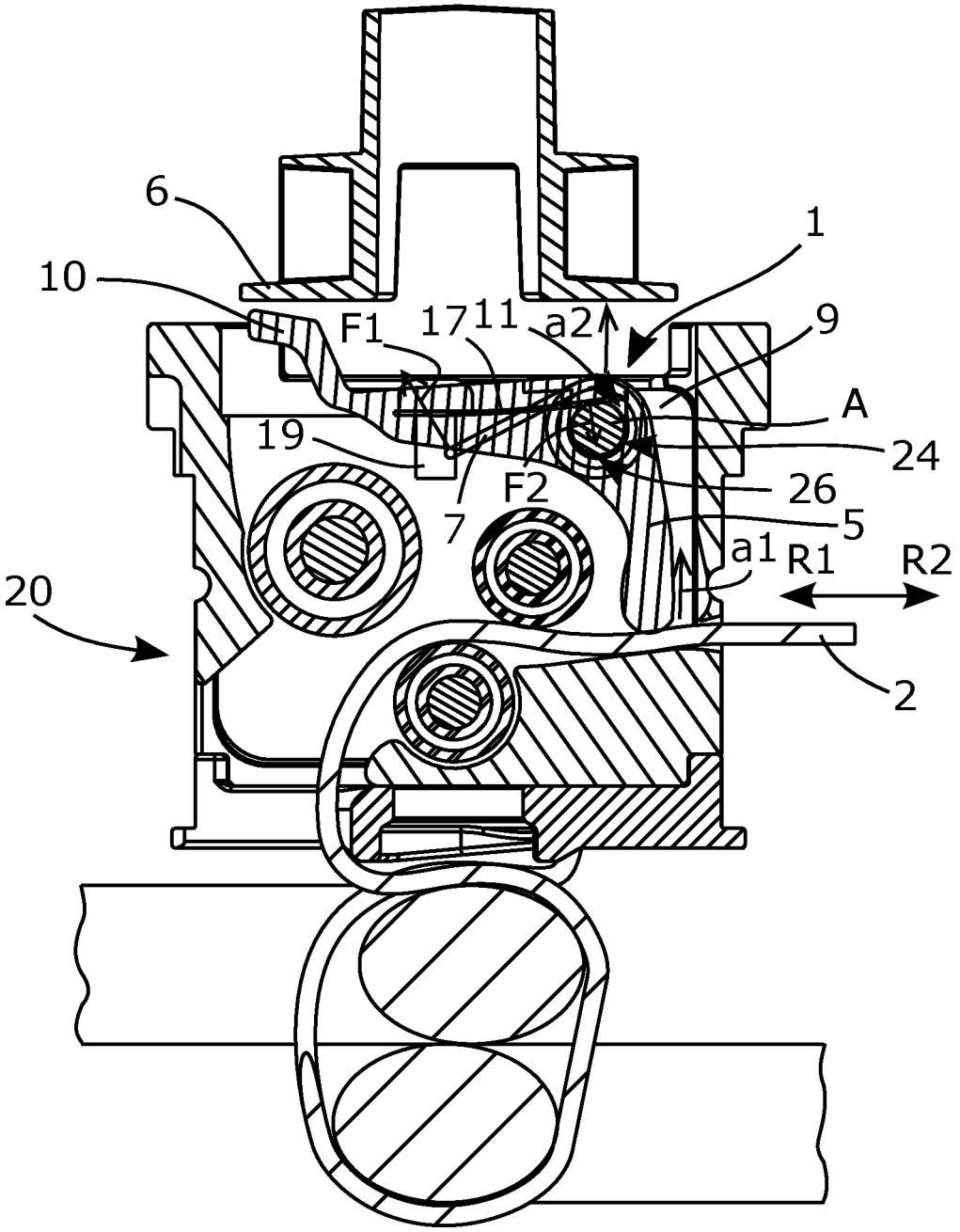
FIG. 3 shows another embodiment of the arrangement in the second position.
Figure 4:
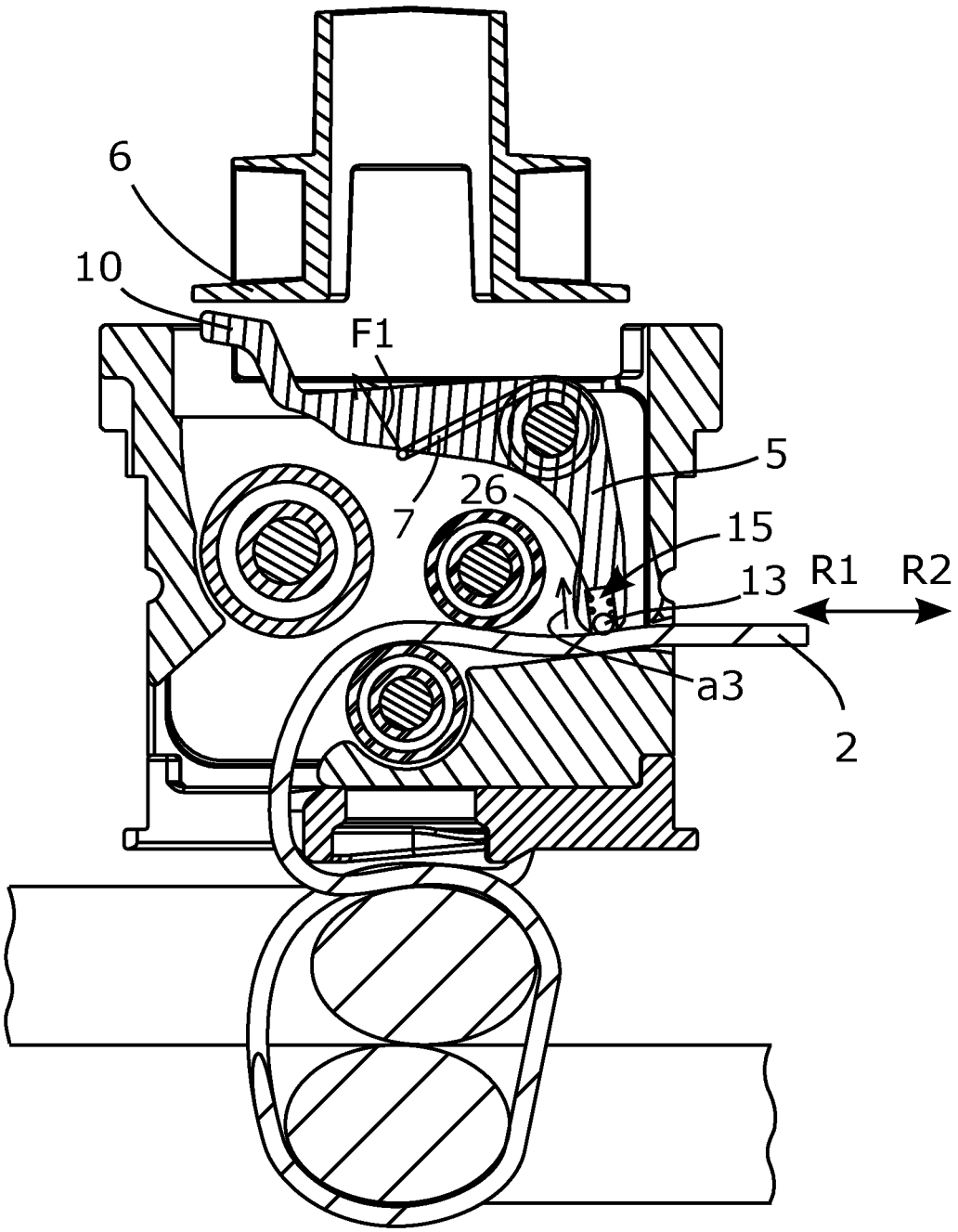
FIG. 4 shows a further embodiment of the arrangement in the second position.

The guide cylinder 6 is arranged to assume at least two different positions: a to-position and a from-position. In said to-position the guide cylinder 6 presses against the rear part 10 of the guide member 5, and in the from-position (which is illustrated in FIG. 2-4) the guide cylinder 6 has been moved from the rear part 10 and does not then have contact with the rear part 10.

Guidance of the position of the guide cylinder 6 is conducted in a known manner and is therefore not described in detail herein.

According to certain embodiments illustrated in FIG. 1, the guide member 5 can be arranged rotatably about a shaft A. The guide member 5 can then be mounted on the shaft A via, for example, an antifriction bearing (not shown), or without a bearing. The guide member 5 can be fastened to the shaft A, so that a rotation of the guide member 5 induces rotation of the shaft A. In addition, the first spring 7 can be arranged so that the first spring force F1 induces rotation of the guide member 5 about the shaft A toward the wire 2.

The first spring 7, which, for example, can be a helical spring or a torsion spring, can be fitted around the shaft (A) and biased against the guide member 5 via a transmission part 12. Hence the first spring force F1 can be transmitted to the guide member 5 via the transmission part 12. The transmission part 12 can, for example, constitute a part of the first spring 7. As is illustrated in FIG. 1, the transmission part 12 can be arranged in a direction substantially perpendicular to an extent of the first spring 7, i.e. substantially perpendicular to the plane of the figure. Hence the transmission part 12 can act against a surface 14 of the guide member 5.

As has been mentioned above, FIG. 1 illustrates the arrangement 1 in the first position, in which the guide cylinder 6 presses against the guide member 5 via the rear part 8. When the guide cylinder 6 presses against the rear part 8, the first spring force F1 is surmounted by a compressive force from the guide cylinder 6, and a rotational movement in a first direction of rotation r1, for example a counterclockwise movement, of the guide member 5 about the shaft A is realized.

The arrangement 1 and a support 16 of the wire binding machine are arranged so that a passage 18 for the wire 2 between the guide member 5 and the support 16 is created. In said first position of the arrangement 1, in which the guide cylinder 6 presses against the rear part 10, the distance between the guide member 5, more specifically the front part 8, and the support 16 becomes larger due to said rotational movement of the guide member 5 in the first direction of rotation r1. Hence the passage 18 also becomes larger, which makes it easier for the wire 2 to pass between the guide member 5 and the support 16 during feed-out of the wire 2.

The wire 2 can be made of various materials, such as, for example, steel, aluminum or other metals. The wire 2 can also be, for example, plastic-coated wire. The wire can have various cross sections, for example a circular cross section or a square cross section.

FIG. 2 shows the arrangement 1 illustrated in FIG. 1 in a second position for guidance of the wire 2.

In the use of a wire binding machine, after the wire 2 has been fed out, the wire 2 is tightened in order to create a tight binding together of rods 4. Upon tightening of the wire 2, the wire 2 is moved in a second direction R2. In addition, after the wire 2 has been tightened, i.e. has been pulled in the second direction R2, a rotary head 20 is made to rotate in order to spin around the wire 2 and form a knot. This phase of a wire binding process can also be termed tightening of the wire when a knot is to be formed. When the rotary head 20 rotates, the wire is pulled in the first direction R1.

During tightening of the wire 2, i.e. when the wire is pulled in the second direction R2 and when a knot is to be created as the wire is pulled in the first direction R1, it is advantageous that the wire is guided and held with a predetermined force in order for the rods to be able to be correctly bound together with a tight knot. The guide member 5 is therefore arranged to have contact with the wire 2 during tightening of the wire.

The arrangement 1 comprising the guide member 5 and the first spring 7 is used precisely for guidance of the wire 2 upon tightening of the wire 2, in order to make the wire 2 tighter around the rods 4, and is used in tightening of the wire 2 when a knot is to be formed. This in the second position, which is illustrated in FIG. 2.

According to the embodiment shown in FIG. 2, the guide cylinder 6 has been moved away from the guide member and from the rear part 10 of the guide member 5, so that no contact exists between the guide cylinder 6 and the rear part 10. The guide cylinder 6 can be moved so that a contact with the rear part is retained.

Once the guide cylinder 6 has been moved from the rear part 10, a rotational movement in a second direction of rotation r2, for example a clockwise movement, of the guide member 5 about the shaft A is realized. This since the guide cylinder 6 does not counteract said first spring force F1 in said second position. The guide cylinder 6 can be moved so that it at least partially counteracts the first spring force F1.

In the second position of the arrangement 1, which is realized by a change of position of the guide cylinder 6 relative to the guide member 5 and by action of the first spring force F1, as has been described above, the guide member 5 is arranged to bear against the wire 2 and act against the wire with said first spring force F1 in order to guide the wire 2. The first spring force F1 is transmitted via the guide member 5 to the wire 2 in the form of a compressive force which presses the wire 2 against the support 16. In this way, the movement of the wire in the first direction R1 and in the second direction R2 upon tightening of the wire 2 can be directed, i.e. controlled, in a simple manner.

Upon tightening of the wire 2 when a knot is to be formed, i.e. when the wire 2 is pulled in the first direction R1 and when the guide member 5 bears against the wire 2 and acts against the wire 2 with said first spring force F1 in order to guide the wire 2, friction forces between the guide member 5 and the wire 2 can increase owing to increased compressive forces against the wire 2 caused by, for example, the shape of the guide member and by a rotational movement of the guide member 5 in the second direction of rotation r2.

If the friction forces between the guide member 5 and the wire 2 are too high, there is a risk of the wire 2 becoming locked against the guide member 5, which can cause the wire 2 to not be properly tightened when a knot is to be formed, which in turn can cause the rods 4 to not be correctly and tightly bound together. In addition, when the wire 2 is locked against the guide member 5, the wire can snap.

The guide member 5 is therefore arranged so that a movement of the guide member 5 substantially away from the wire 2 is allowed in order to reduce the above-described friction forces between the guide member 5 and the wire 2 during said tightening of the wire 2 when a knot is to be formed.

Hence the guide member 5 or a part of the guide member 5, for example the front part 8, can move, i.e. change position relative to the wire 2 in a direction away from the wire 2. For example, the guide member 5 or a part of the guide member 5 can move in a first direction a1 substantially perpendicular to the extent of the wire 2.

According to an embodiment which is illustrated in FIG. 2, the guide member 5 can be arranged so that said movement of the guide member 5 substantially away from the wire 2, for example in the direction a1, is allowed by a deformation of the guide member 5.

The guide member 5 is hence arranged to allow a movement of the guide member 5 substantially away from said wire. In this way, friction forces between the guide member 5 and the wire during a wire binding process are reduced. Consequently, locking of the wire against, or in relation to, the guide member 5 is prevented. In other words, the wire is prevented from catching against the guide member 5.

The guide member 5 can comprise a waist 22, i.e. a constriction. The waist 22 is then configured so that the middle portion of the waist, in which the width b of the guide member 5 is smallest, allows the guide member 5 to be able to be deformed without it coming part, i.e. without the guide member 5 being broken off. The guide member 5 can, for example, be made from steel, and hence a degree of elastic deformation at said waist 22 is allowed. Consequently, the front part 8 can change its position relative to the wire 2 along the direction a1, in order to reduce friction forces between the wire 2 and the guide member 5 as the wire is pulled in the direction R1 when a knot is to be formed. Said friction forces can in certain situations exceed a value which can cause the wire 2 to be locked against the guide member 5 during the pulling of the wire 2 in the direction R1. Since the front part 8 of the guide member 5 can move away from the wire 2, said friction forces which can cause the wire 2 to be locked against the guide member 5 can be reduced, and hence locking of the wire 2 against the guide member 5 can be prevented.

During said deformation, i.e. said elastic deformation, of the guide member 5, the contact between the guide member 5 and the wire 2, likewise the action of the first spring 7, is retained. Guidance of the wire 2 during the tightening of the wire 2 when a knot is to be formed is hence maintained.

According to certain embodiments, the guide member 5 can comprise an elastic material, such as, for example, rubber or a plastics material. The guide member 5 can then be partially or wholly made of the elastic material, i.e. a part of the guide member 5 can comprise the elastic material.

The guide member 5 comprising an elastic material can be configured with or without said waist 22. Said deformation of the guide member 5 can mean an elastic deformation, for example compression of a part of the guide member 5.

FIG. 3 shows another embodiment of the arrangement 1 illustrated in the second position i.e. once the guide cylinder 6 has been moved away from the rear part 10.

The guide member 5 can be arranged rotatably about the shaft A, which means that the guide member 5 can be mounted on the shaft A via, for example, an antifriction bearing (not shown), or without a bearing.

According to embodiments illustrated in FIG. 3, the arrangement 1 can comprise a mounting part 9 for mounting of the shaft A in the mounting part 9. The mounting part 9 can, for example, be configured as a plate 9, which can be fastened in the rotary head 20 by, for example, welding, or with the aid of screws. The plate 9 can be made of a metal material and the plate 9 can comprise an opening 24 for the reception, and hence mounting, of the shaft A in the plate 9.

The mounting part 9 can further comprise a groove 11. The groove 11 can be arranged as a part of said opening 24 for mounting of the shaft A, so that a connection between the opening 24 and the groove 11 is realized. In this way, the shaft A can be moved substantially freely between the opening 24 and the groove 11. As an alternative, the opening 24 can comprise a bottom part 26 having a circular cross section. In addition, the cross section of the bottom part 26 can have the shape of a semicircle. The groove 11 can be configured so that a cross section of the groove 11 forms an extension of said semicircle of the cross section of bottom part 26 toward an edge of the mounting part 9.

As has been described above, by "the movement of the guide member 5 substantially away from the wire 2" is meant that the guide member 5 or a part of the guide member can move, i.e. change position, relative to the wire 2 in a direction away from the wire 2. For example, the guide member 5 or a part of the guide member 5 can move in a first direction a1 substantially perpendicular to the extent of the wire. Said extent of the wire 2 alludes to an extent of the wire 2 in the vicinity of a contact region between the guide member 5 and the wire 2.

Since the mounting part 9 comprises said groove 11 and the guide member 5 can be mounted on the shaft A, said movement of the guide member 5 substantially away from the wire 2 can induce a movement of the shaft A substantially away from the wire 2, for example the shaft A can move in a second direction a2 substantially perpendicular to the extent of the wire. In such an embodiment, both the guide member 5 and the shaft A are moved away from the wire 2.

In much the same way as has been described in connection with FIG. 2, when the wire 2 is pulled in the direction R1 friction forces between the wire 2 and the guide member 5 can in certain situations exceed a value which can cause the wire 2 to be locked against the guide member 5. Since the guide member 5 and the shaft A can move away from the wire 2, said friction forces which can cause the wire 2 to be locked against the guide member 5 can be reduced, and hence locking of the wire 2 against the guide member 5 can be prevented.

According to certain embodiments, the guide member 5 can comprise a guide groove (not shown), so that, upon a movement of the guide member 5 substantially away from the wire 2, the guide member 5 is moved along the guide groove and the shaft A retains its original position relative to the wire.

During said movement of the guide member 5 substantially away from the wire 2, the contact between the guide member 5 and the wire 2, likewise the action of the first spring 7, is retained. Hence guidance of the wire 2 during the tightening of the wire 2 when a knot is to be formed is maintained.

The arrangement 1 can comprise a second spring 17 arranged to counteract said movement substantially away from the wire with a second spring force F2. The second spring 17 can, for example, comprise a leaf spring.

The second spring force F2, which is generated by the second spring 17, can therefore act in a direction toward the wire which is substantially opposite to the direction for the movement of the guide member 5 substantially away from the wire 2, for example the second spring 17 can act in an opposite direction to the first direction a1. Hence said movement away from the wire 2 can be limited and balanced and controlled with the aid of the second spring 17. As a result, the wire 2 can be guided with a balanced force during tightening of the wire 2 when a knot is to be formed, at the same time as locking of the wire 2 against the guide member 5 is prevented with the aid of the arrangement 1.

The second spring 17 can be arranged to act on the shaft A with said second spring force F2. In other words, the second spring 17 can have contact with the shaft A. As an alternative, the second spring 17 can act on the guide member 5, i.e. the second spring 17 can have contact with the guide member 5.

The arrangement 1 can comprise a tensioning device 19, such as, for example, a screw, for regulating the second spring force F2. The second spring force F2 can thereby be adjusted and adapted with the aid of the tensioning device 19 in dependence on various drive factors during the wire binding process, for example in dependence on the thickness of the wire 2. When a screw is used, the tension in the second spring 17 can be adjusted by screwing of the screw in order to increase the tension in the second spring 17 and hence increase the second spring force F2, or in order to reduce the tension in the second spring 17 and hence reduce the second spring force F2.

FIG. 4 shows a further embodiment of the arrangement 1 in the second position, i.e. once the guide cylinder 6 has been moved from the rear part 10 of the guide member 5.

According to the further embodiment which is shown in FIG. 4, the guide member 5 can comprise a guide element 13, such as, for example, a ball or a cylindrical body such as a roller. The guide element 13 is arranged to bear against the wire 2 and act against the wire 2 with the first spring force F1 from the first spring 7. The guide element 13 is movably arranged so that a movement of the guide element 13 substantially away from the wire 2 is allowed in order to reduce friction forces between the guide element 13 and the wire 2 during the wire binding process as the wire 2 is pulled in the first direction R1 when a knot is to be formed. By "substantially away from the wire 2" is meant that the guide element 13 can move, i.e. change position, relative to the wire 2 in a direction away from the wire 2, but not toward the wire 2. For example, the guide element can move in a third direction a3 substantially perpendicular to the extent of the wire 2.

The guide member 5 can comprise a recess 15, i.e. a cavity arranged to allow said movement of the guide element 13 substantially away from the wire 2 at least partially in the recess 15. The guide element 13 can hence change its position in relation to the wire 2 and move along the walls of the recess 15, which hence can guide the movement of the guide element 13 in said third direction a3.

In the recess 15, a third spring 26 can be mounted in order to counteract and balance said movement of the guide element 13 substantially away from the wire 2. The function of the third spring 26 resembles in terms of its purpose the second spring 17 described above.

Figure 5:
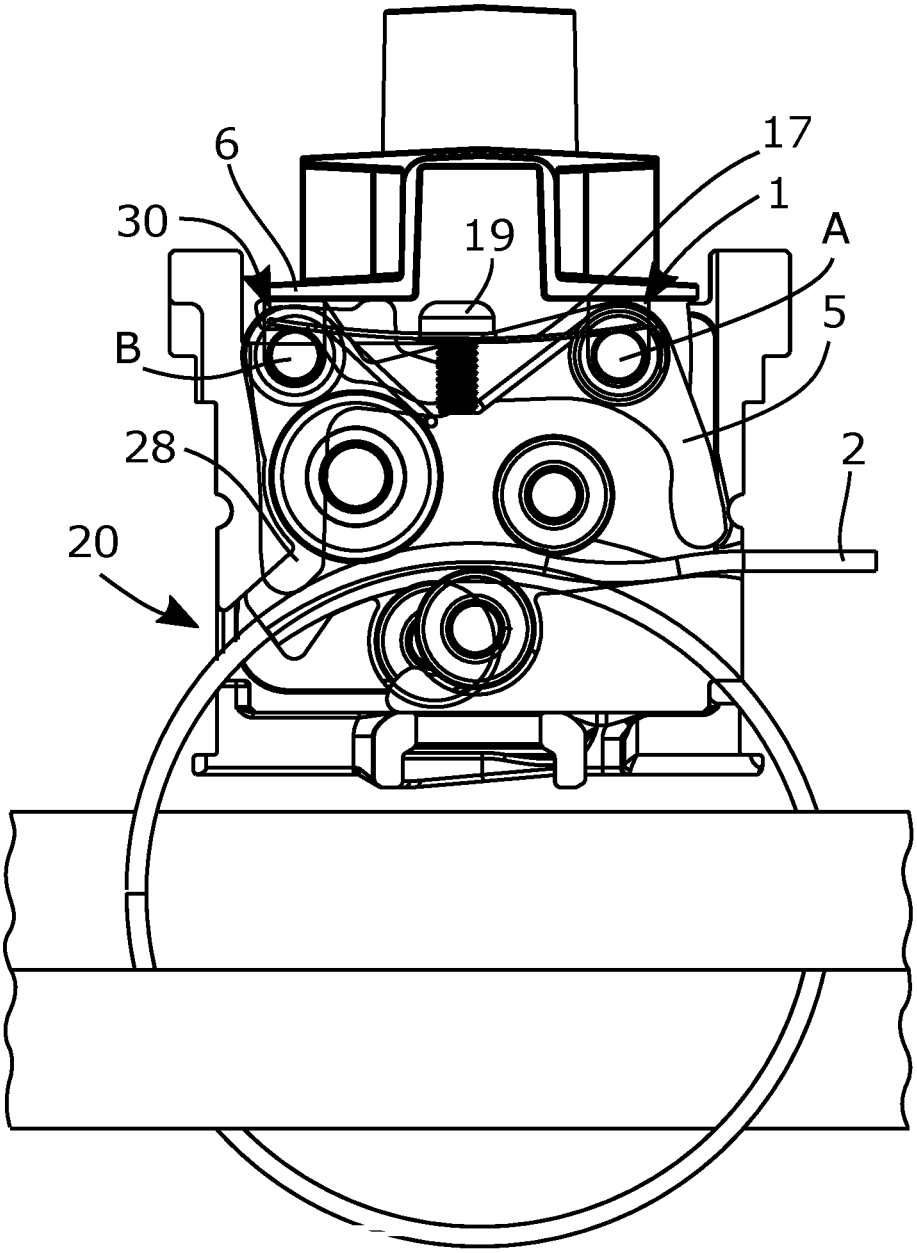
FIG. 5 shows a second spring mounted on the arrangement.

FIG. 5 shows an alternative way of mounting the second spring 17. As is illustrated in FIG. 5, a further guide member 28 can be arranged in the rotary head 20. The further guide member 28 can be arranged rotatably about a further shaft B and can be included in a further arrangement 30, which can designed like the arrangement 1 and can comprise parts like the arrangement 1 as described above. The further arrangement 30 and the arrangement 1 are illustrated in the first position, in which the guide cylinder 6 presses against both the guide member 5 and the further guide member 30. This during feed-out of the wire 2. The guide member 5 can sometimes be termed a feeder, and the further guide member 28 can be termed a catcher.

According to embodiments presented in FIG. 5, the second spring 17 is arranged to act against both the shaft A and the further shaft B. The tensioning device 19, such as, for example, a screw 19, can be used to regulate the tension in the second spring 17.

Figure 6:
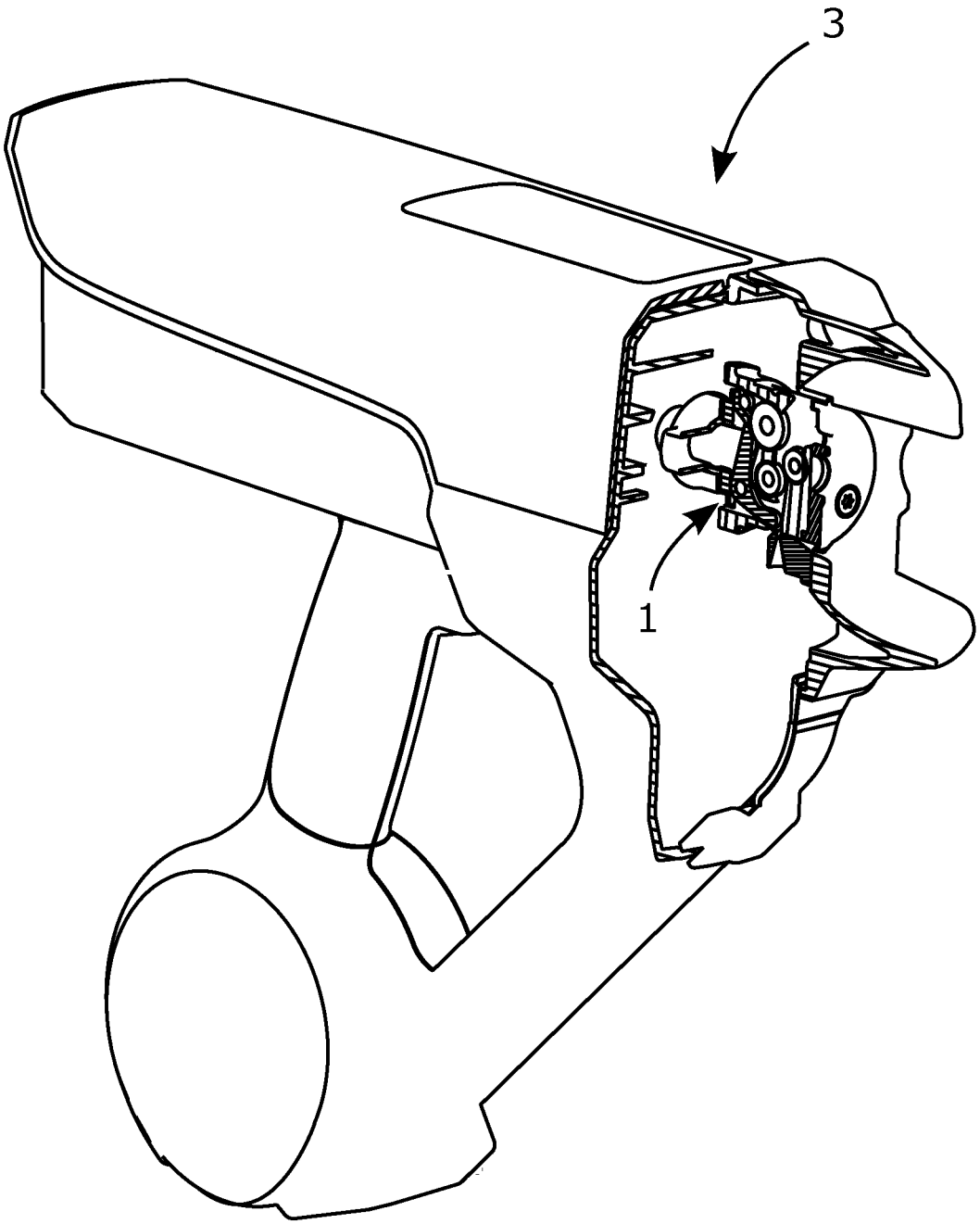
FIG. 6 shows a wire binding machine comprising the arrangement.

FIG. 6 shows a wire binding machine 3 comprising an arrangement 1 according to the above.

The invention claimed is:

1. An arrangement for guiding a wire in a wire binding machine, wherein the arrangement comprises a guide member and a first spring arranged to act with a first spring force against the guide member, wherein the guide member is arranged to bear against the wire and act against the wire with said first spring force in order to guide the wire during a wire binding process when the wire moves relative to the guide member, wherein the guide member is movably arranged to move substantially away from said wire to reduce friction forces between the guide member and the wire during said wire binding process, so that locking of the wire against the guide member is prevented, wherein the guide member is arranged rotatably about a shaft, wherein the first spring is arranged so that said first spring force induces rotation of the guide member about the shaft toward the wire, and wherein said movement substantially away from the wire induces a movement of said shaft substantially away from the wire.

2. The arrangement as claimed in claim 1, comprising a mounting part for mounting of the shaft in the mounting part, wherein the mounting part comprises a groove arranged to allow said movement of the shaft substantially away from the wire.

* * * * *